US005088009A

United States Patent [19]

Harada et al.

[11] Patent Number: 5,088,009

[45] Date of Patent: Feb. 11, 1992

[54] SURFACE-MOUNTING CONNECTOR

[75] Inventors: Katsumi Harada; Toshiaki Nagafuji; Wataru Takahashi, all of Tokyo; Kenichi Nakano, Kokubunji; Kei-ichi Yasuda, Tokyo, all of Japan

[73] Assignees: NEC Corporation; Nippon Telegraph and Telephone Corporation, both of Tokyo, Japan

[21] Appl. No.: 625,667

[22] Filed: Dec. 13, 1990

[30] Foreign Application Priority Data

Dec. 15, 1989 [JP] Japan ..... 1-326911

[51] Int. Cl.[5] ..... H01R 23/68

[52] U.S. Cl. ..... 361/413; 439/79; 439/931

[58] Field of Search ..... 361/400, 413, 425, 426; 439/76, 79, 89, 931

[56] References Cited

U.S. PATENT DOCUMENTS 4,418,972 12/1983 Benasutti ..... 439/79
4,557,541 12/1985 Steuernagel et al. ..... 439/79
4,631,637 12/1986 Romania et al. ..... 361/413

FOREIGN PATENT DOCUMENTS 59-49172 3/1984 Japan .
62-9980 3/1987 Japan .

*Primary Examiner*—Leo P. Picard
*Assistant Examiner*—Donald A. Sparks
*Attorney, Agent, or Firm*—Foley & Lardner

[57] ABSTRACT

A surface-mounting connector includes a repeater pin block and connector pins. The repeater pin block includes a main body consisting of a resin and having regularly arranged through holes, and a continuously extended resin spring contact portion integrally and continuously extending from the main body to be brought into contact with a surface of a printed board. The main body and the continuously extended resin spring contact portion have contact portions to be brought into contact with conductive pads of the printed board and conductive paths to be connected to the regularly arranged through holes. Each connector pin has a first pin portion on its one end. The first pin portion has a press-fit structure and is forcibly inserted in a corresponding through hole. Each connector pin also has a second pin portion on its other end. The second pin portion is used for electrical connection with an external unit. The contact portions to be brought into contact with the conductive pads arranged in a row on the same surface of the printed board are arranged on the continuously extended resin spring contact portion.

17 Claims, 6 Drawing Sheets

SURFACE-MOUNTING CONNECTOR

BACKGROUND OF THE INVENTION

The present invention relates to a high-density mounting multi-pin connector used for, e.g., a computer, an electronic exchange, and a data transmitter and, more particularly, to a surface-mounting connector to be connected to a printed board by surface mounting.

When a conventional connector of this type, e.g., a female connector, is designed to be arranged on a printed board, a large number of L-shaped female connector pins arranged parallel in two to four rows are used. More specifically, as shown in FIG. 6, in a female connector 81 arranged on a printed board 8, each L-shaped connector pin 82 is constituted by a metal spring. One end of each pin 82 is inserted/connected in/to a corresponding through hole 83 of the printed board 8 or is urged against a corresponding metal pad 84 typically consisting of a solder so as to be connected thereto by soldering, thus ensuring electrical connection with a circuit in the printed board 8.

The other end of each of the connector pins 82 is arranged in a corresponding pin insertion hole 85 of the female connector 81, whereas each rod-like male connector pin 88 of a male connector 87 arranged on a wiring board 86 is inserted in a corresponding insertion hole 85. With this arrangement, the two connectors 81 and 87 are set in a coupled state. Such a connector is disclosed in, e.g., Japanese Patent Laid-Open No. 59-49172.

If, however, such a connector is used for a high-speed logic apparatus such as a supercomputer and an ultra-high-speed wide-band electronic exchange, since each L-shaped female connector pin 82 has a long lead, high-frequency characteristics are adversely affected in terms of crosstalk amount, ground noise, delay time, and the like.

With an increase in number and density of pins of a connector, the distance between adjacent pads is reduced. In addition, wires of 100 $\mu$ width must be arranged between such adjacent pads at a pitch of about 300 $\mu$. However, pitch errors at the printed board 8 side end portions, i.e., free ends, of the female connector pins 82 cannot be avoided. This makes it difficult to solder the connector pins to the metal pads arranged at a high density, and tends to develop short circuits between adjacent wires and in adjacent pads or cause connection failures. Moreover, since the pads respectively corresponding to a large number of connector pins are arranged on the printed board in the form of a matrix at a high density, it is very difficult to perform repair work once the above-mentioned short circuit or connection failure occurs.

That is, the drawbacks of the conventional connector are degradation in electric signal transmission characteristics due to the long leads of the connector pins 82 and poor assembly efficiency with respect to the printed board 8.

SUMMARY OF THE INVENTION

It is an object of the present invention to provide a surface-mounting connector which can easily realize a high-density arrangement without causing a short circuit or a connection failure.

It is another object of the present invention to provide a surface-mounting connector which facilitates mounting and soldering of pins.

It is still another object to provide a surface-mounting connector which can improve assembly efficiency by arranging pins in a row with high pitch precision.

It is still another object of the present invention to provide a surface-mounting connector which can improve high-frequency characteristics by minimizing the effective electrical path amount of each pin and can further improve the high-frequency characteristics by arranging a ground line near each signal line.

In order to achieve the above objects, according to the present invention, there is provided a surface-mounting connector, mounted on a printed board, for electrically connecting the printed board to an external unit, comprising a repeater pin block including a main body consisting of a resin and having regularly arranged through holes, and a resin spring contact portion integrally and continuously extending from the main body to be brought into contact with a surface of the printed board, the main body and the resin spring contact portion having contact portions to be brought into contact with conductive pads of the printed board and conductive paths to be connected to the through holes, and connector pins each having a first pin portion on one end thereof, the first pin portion having a press-fit structure and being forcibly inserted in a corresponding one of the through holes, and a second pin portion on the other end thereof, the second pin portion being used for electrical connection with the external unit, wherein the contact portions to be brought into contact with the conductive pads arranged in a row on the same surface of the printed board are arranged on the continuously extended resin spring contact portion.

DESCRIPTION OF THE PREFERRED EMBODIMENTS

The present invention will be described below with reference to the accompanying drawings.

Figure 1:
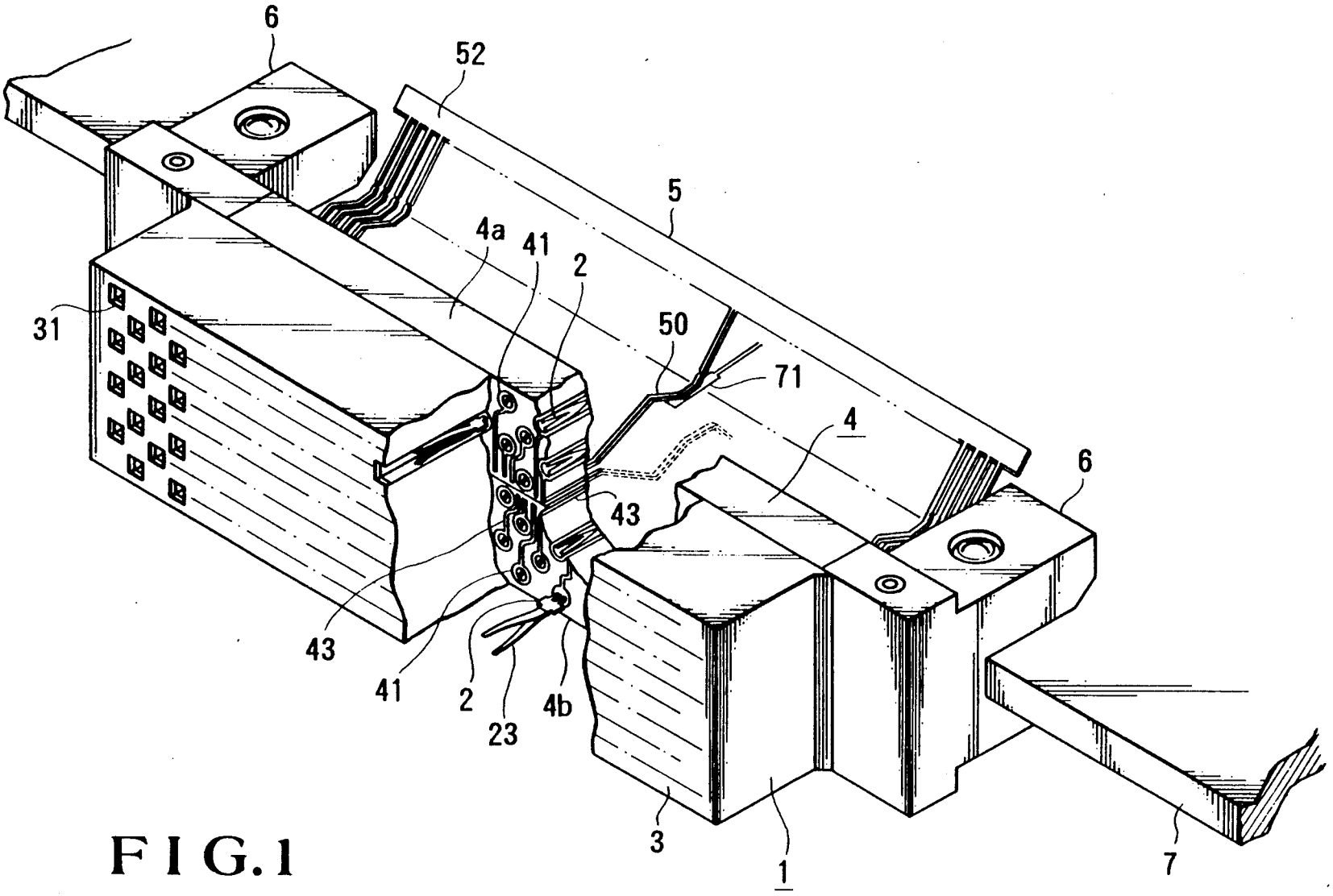
FIGS. 1 and 2 are a partially cutaway perspective view and a partially cutaway side view, respectively, of the first embodiment of the present invention.
Figure 2:
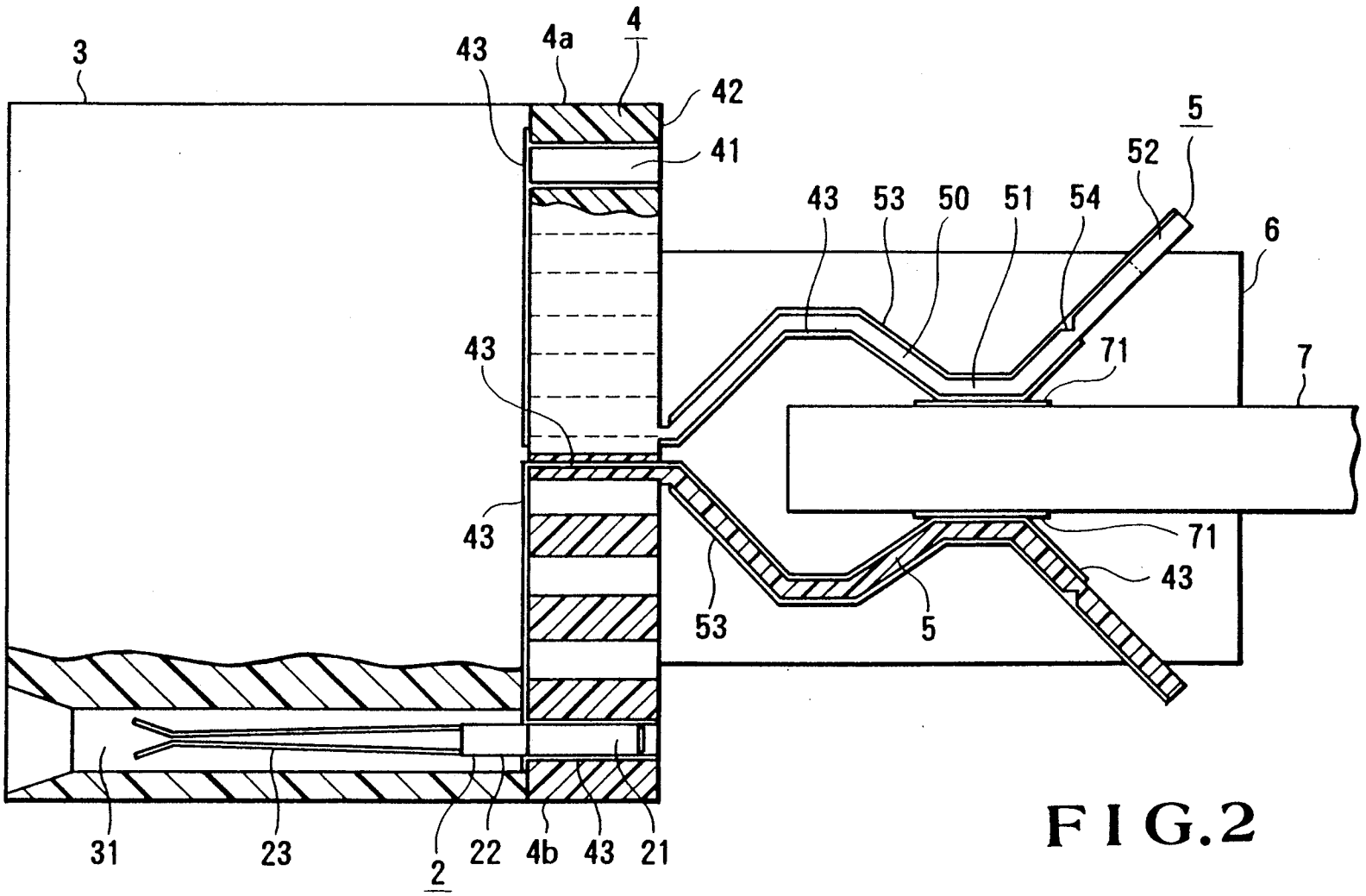

FIGS. 1 and 2 show the first embodiment of the present invention.

Referring to FIGS. 1 and 2, a female connector 1 according to the first embodiment of the present invention comprises female connector pins 2, a housing 3 having a large number of pin insertion holes 31 in which the connector pins 2 are respectively arranged, a repeater pin block 4 having through holes 41 in which the female connector pins 2 are inserted/fixed, resin spring contact portions 5 integrally molded to extend from the repeater pin block 4, and support portions 6 for fixing the overall female connector 1 to a printed board 7.

In this embodiment, a circuit on the printed board 7 is electrically connected to an external unit through the following path: pads 71 on the printed board 7—conductive wiring patterns (to be described in detail later) of the resin spring contact portion 5—the conductive through holes 41 of the repeater pin block 4—the female connector pins 2—rod-like male connector pins (not shown) of an external connector.

A detailed arrangement of the first embodiment will be described below.

The repeater pin block 4 is constituted by two blocks 4*a* and 4*b* are vertically stacked on each other. Each of the blocks 4*a* and 4*b* is formed by a double-molding method using an insulating resin consisting of a plastic material such as an ULTEM resin (trade name of General Electric Co.) or a liquid crystal resin, and a conductive resin such as a conductive plastic material. Each of the blocks 4*a* and 4*b* is constituted by a main body 42 having the large number of through holes 41, and the comb-like resin spring contact portion 5 with slight elasticity, which integrally extends from one side of the main body 42, and has wiring patterns 43 (conductive paths) consisting of a conductive resin. The two resin spring contact portions 5 are bent to allow the printed board 7 to be received therebetween when the two blocks 4*a* and 4*b* are stacked on each other. The wiring patterns 43 are exposed on contact portions 51 of beam-like contacts 50 which are respectively brought into direct contact with the pads 71 of the printed board 7. These wiring patterns 43 are arranged on the outer and inner surfaces of the resin spring contact portions 5 and of the main bodies 42 and are electrically connected to the through holes 41 at the rear surfaces of the main bodies 42 (on the housing 3 side). That is, the contact portions 51 respectively correspond to the through holes 41. The free ends of the beam-like contacts 50 constituting a comb-like shape are coupled to each other by carriers 52. In addition, ground patterns 53 are respectively formed on the rear surfaces of the resin spring contact portions 5 which are opposite to the surfaces having the wiring patterns 43 formed thereon. Since the ground patterns 53 are also formed to extend on each carrier 52, the patterns 53 on the beam-like contacts 50 of the same contact portion 5 are coupled to each other through the carrier 52, and are then connected to ground through holes in the main body 42 through arbitrary beam-like contacts. Note that if the beam-like contact 50 include the signal patterns 43, the ground patterns 53 terminate at the proximal end portions of the contacts 50 but do not reach the main body 42.

The press-fit type female connector pins 2 to be connected without soldering are respectively inserted/fixed in the through holes 41 formed in each main body 42 in the form of a matrix suitable for high-density mounting. More specifically, each connector pin 2 comprises: a press-fit pin portion 21 which has, e.g., a flexible press-fit structure with an N-shaped cross-section and is forcibly inserted/fixed in a corresponding through hole 41; a slightly wide lock portion 22; and a female contact portion 23 to be brought into contact with a rod-like male connector pin (not shown) which is inserted into a corresponding hole 31 of the housing 3. Such a press-fit type pin is disclosed in, e.g., Published Examined Japanese Patent Application No. 62-9980.

The female connector 1 having the above-described arrangement is mounted on the printed board 7 in the following manner. The printed board 7 is inserted between the opposite resin contact portions 5. As a result, each contact portion 51 is urged against a corresponding pad 71 by the elastic force of the resin. Since the relative positions of the beam-like contacts 50 are fixed by the carriers 52, the beam like contacts 50 can be connected to the pads 71 of the printed board 7 with high positional precision. Thereafter, the contact portions 51 are respectively soldered to the pads 71. In order to facilitate this soldering operation, the contact portions 51 may be plated with a solder in advance. The overall connector is fixed to the printed board 7 by screws or the like through the support portions 6.

As described above, a group of connector pins corresponding to a group of pads 71 on the same surface of the printed board 7 (i.e., the pins arranged on the block 4*a* in the form of a matrix) are arranged in a row on the resin spring contact portion 5 at high density. The connector pins in a high-density state are brought into contact with the pads 71 arranged on the printed board 7 in a row. With this arrangement, no pitch errors are caused, and the assembly efficiency can be greatly improved.

In addition, the press-fit type pins are employed, which allows easy manufacture of the repeater pin block 4 and allows connection to an external connector by only forcible insertion of the pins into the through holes. Therefore, the assembly efficiency and ease in the manufacture of the overall connector can be improved. In addition, the connector of the present invention can be easily adapted for an automated process.

Furthermore, since the metal connector pins 2 having high durability can be used at portions to be connected to an external connector, these portions being subjected to frequent insertion during a maintenance operation or the like, high reliability can be ensured. In addition, each surface-mounting portion of the printed board 7 is designed for a one-row arrangement of pins, and hence the pads 71 on the printed board 7 can be arranged in a row on one side of the printed board 7. This allows a reduction in lead length of the connector 1. Moreover, since ground lines can be arranged on a surface opposite to a surface having signal lines formed thereon, the impedance is reduced, and signal attenuation and generation of ground noise can be suppressed.

If required high-frequency characteristics can be achieved without using ground patterns, since the carriers 52 are not necessary any longer after surface mounting of the connector is completed, the carriers 52 may be removed by breaking notched portions (half-cut portions) 54.

The second embodiment of the present invention will be described below with reference to FIG. 3 and FIGS. 4A and 4B. The structures of a repeater pin block 4 and a contact portion 5 in the second embodiment are different from those in the first embodiment. More specifically, in the second embodiment, these members are formed in such a manner that a molded product consisting of an insulating resin (FIG. 4A) is plated with a conductive material (copper) by a printing technique so as to form patterns 43 and 53 (FIG. 4B). In this embodiment, since a surface of the molded product is plated, the wiring patterns 43 on a main body 42 are formed on a surface on a plastic contact 5 side (i.e., on the side of a printed board 7), as shown in FIG. 3.

Since the printing technique allows formation of minute patterns, wiring patterns can be easily formed on each resin spring contact 5 in a one-row arrangement with high precision.

Figure 3:
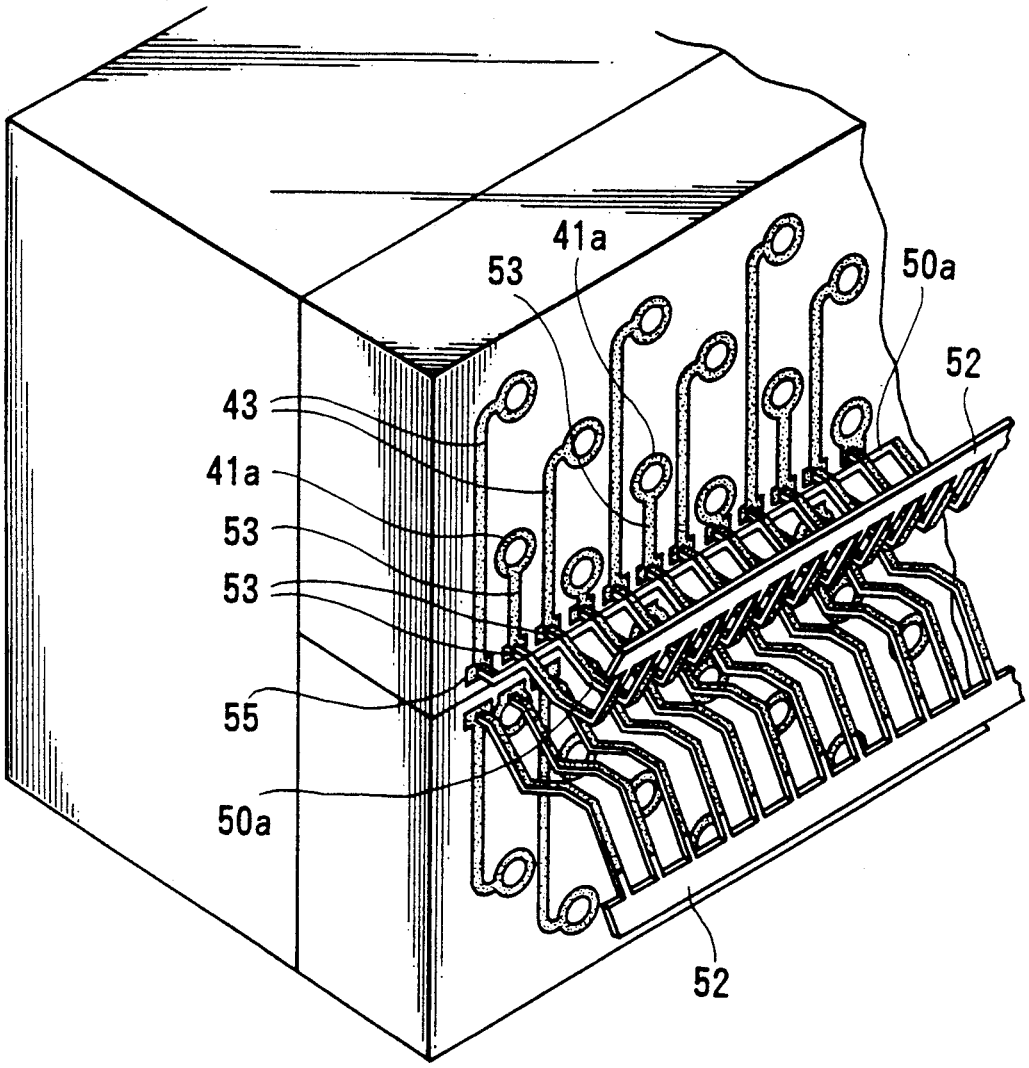
FIG. 3 is a perspective view showing part of the second embodiment of the present invention.
Figure 4A:
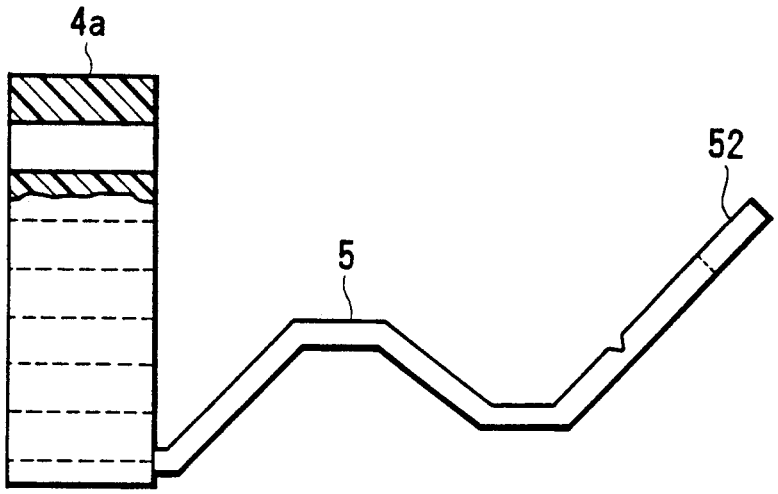
FIGS. 4A and 4B are views for explaining part of a manufacturing process according to the second embodiment.
Figure 4B:
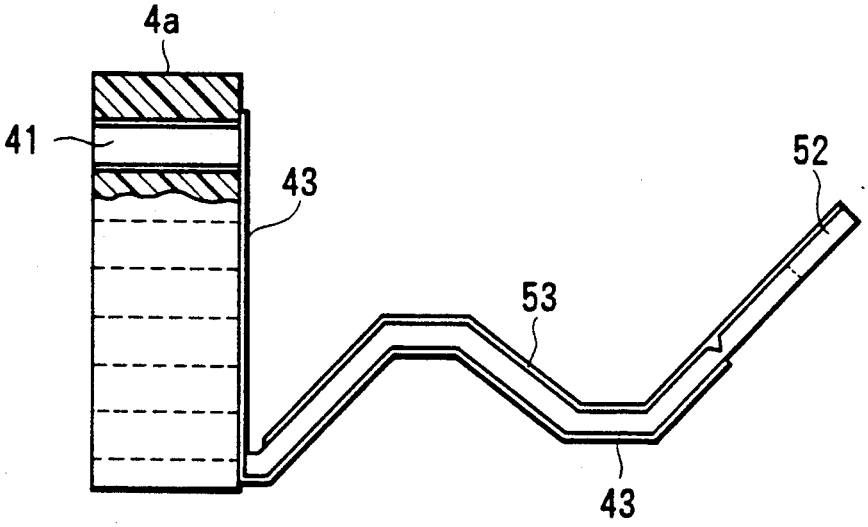

Referring to FIG. 3, through holes 41*a* of a block *4a* serve as ground wiring through holes. The ground patterns 43 connected to these through holes 41*a* extend, through two beam-like contacts 50*a* and a carrier 52, to a position near the proximal ends of other beam-like contacts. However, gaps 55 are formed to prevent contact between the ground patterns 53 and the signal wiring patterns 43, thus insulating the patterns 43 and 53 from each other.

In this embodiment, if the ground patterns 53 need not be formed, each of the wiring patterns 43 may be independently formed by plating, with a conductive material, the entire contact surfaces (including the carriers 52) of the resin spring contact portions 5 which are brought into contact with a printed board 7, and by removing the carriers 52 upon soldering operation.

Figure 5:
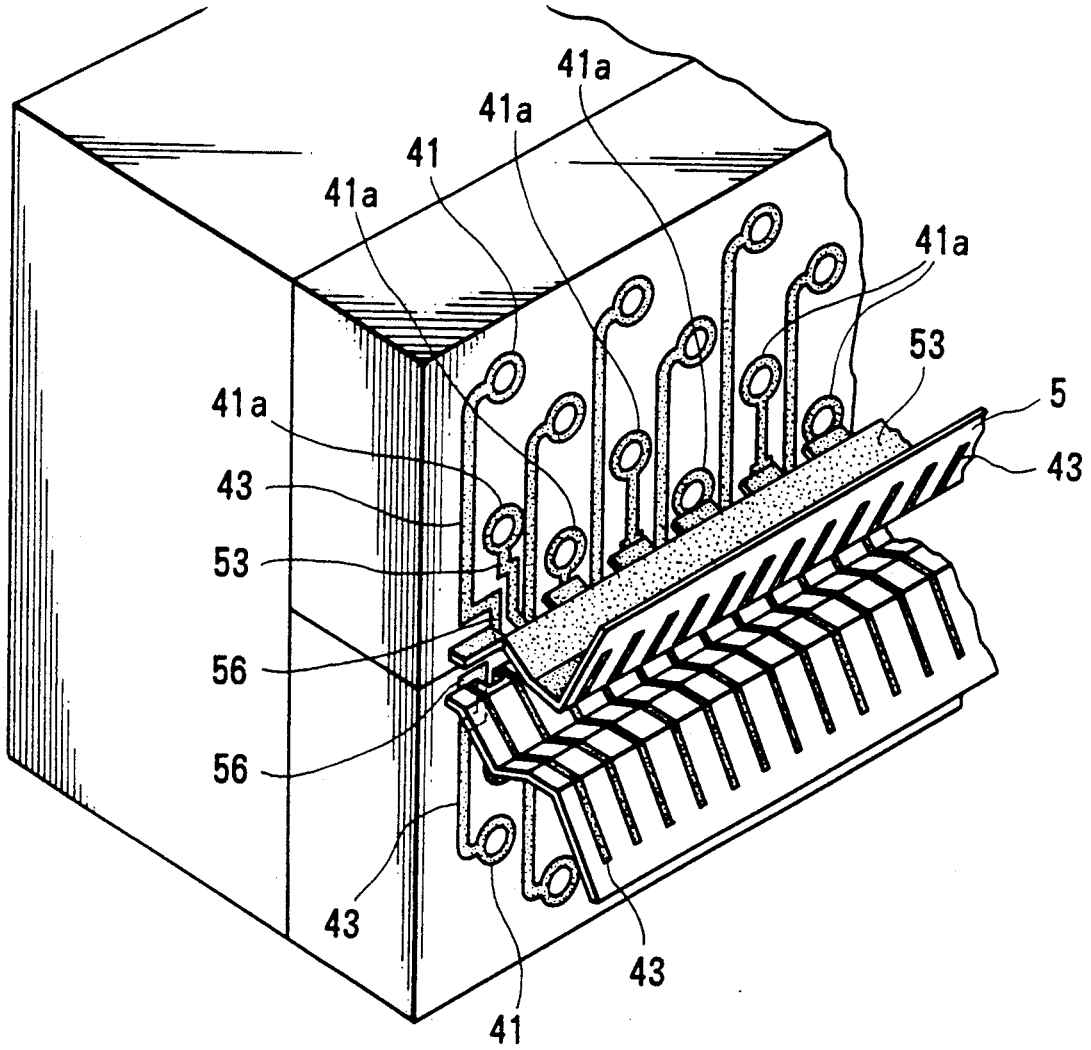
FIG. 5 is a perspective view showing part of the third embodiment of the present invention.
Figure 6:
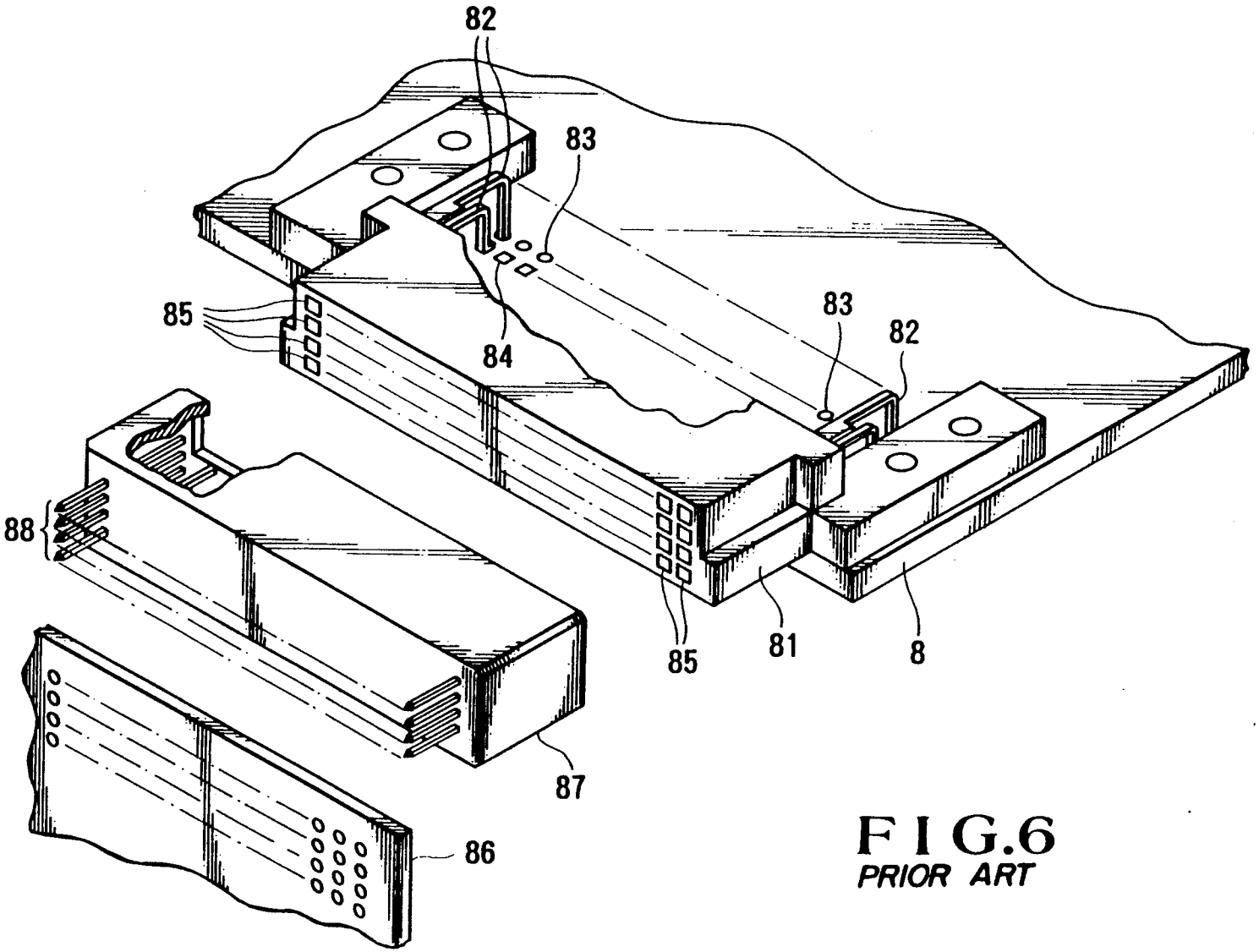
FIG.6 PRIOR ART
FIG. 6 is a partially cutaway perspective view of a conventional connector.

The third embodiment of the present invention will be described below with reference to FIG. 5. In this embodiment, each resin spring contact portion 5 includes one bent contact plate in place of the comb-like contacts. Wiring patterns 43 are formed on the contact surface of each contact portion 5 which is brought into contact with a printed board 7, while a conductive layer as a ground pattern 53 is formed on the surface opposite to the contact surface. Since the wiring patterns 43 on each contact portion 5 are formed on the surface opposite to trough holes 41, notched portions 56 are formed in a proximal portion of each contact portion 5 so as to allow the respective wiring patterns 43 to be electrically connected to the through holes 41 through the notched portions 56.

In the present invention, means for forming wiring and ground patterns (plating and double molding) and the surfaces of each main body 42 (the surface on the housing side and the surface on the printed board side) on which these patterns are formed can be arbitrarily selected.

In each of the above-described embodiments, the repeater pin block 4 is constituted by two blocks 4*a* and 4*b*. However, these blocks may be integrated.

In addition, the repeater pin block 4 and the support portions 6 may be integrated.

Furthermore, in each embodiment, a female connector is exemplified. However, if the contact portions 23 of the connector pins 2 are formed into rod-like pins, a male connector can be formed.

As has been described above, according to the present invention, conductive patterns to be brought into contact with a surface of a printed board on which a connector is surface-mounted are arranged in a row on each spring contact, and each spring contact is integrally formed with a resin block. In addition, the connector is electrically connected to an external unit through press-fit type connector pins forcibly inserted/-fixed in through holes connected to the respective conductive pads in this block. With this arrangement, even if the number of pins is increased, soldering operations during manufacturing and assembly processes can be easily performed, thus allowing an increase in packing density.

In addition, since the electric path length of each signal line of the connector can be reduced, adverse effects on signal characteristics can be suppressed.

Furthermore, if ground patterns are formed on one surface of each spring contact so as to cover at least signal patterns on the other surface of the spring contact, a further improvement in high-frequency characteristics can be achieved.

What is claimed is:

1. A surface-mounting connector, mounted on a printed board, for electrically connecting the printed board to an external unit, comprising:

a repeater pin block including a main body comprising a resin and having regularly arranged through holes, and a continuously extended resin spring contact portion integrally and continuously extending from said main body to be brought into contact with a surface of the printed board, said main body and said continuously extended resin spring contact portion comprising contact portions to be brought into contact with conductive pads of the printed board and conductive paths to be connected to said regularly arranged through holes; and connector pins having a first pin portion on a first end thereof, said first pin portion having a press-fit structure and being forcibly inserted in a corresponding one of said regularly arranged through holes, and a second pin portion on a second end thereof, said second pin portion being used for electrical connection with an external unit, wherein said contact portions to be brought into contact with said conductive pads arranged in a row on the same surface of the printed board are arranged on said continuously extended resin spring contact portion.

2. A connector according to claim 1, wherein said continuously extended resin spring contact portion comprises a comb-like contact having beam-like springs respectively corresponding to said conductive pads, said beam-like springs being brought into contact with said conductive pads, and free ends of said beam-like springs being coupled to each other by a mold carrier.

3. A connector according to claim 2, wherein ground conductive patterns corresponding to at least said conductive paths of said repeater pin block are formed on a surface of said comb-like contact which is not brought into contact with the printed board.

4. A connector according to claim 2, wherein notched portions for removing said mold carrier are respectively arranged between said beam-like springs and said mold carrier.

5. A connector according to claim 1, wherein said continuously extended resin spring contact portion is constituted by one plate-like spring.

6. A connector according to claim 5, wherein a ground conductive layer is formed on the entire surface of said plate-like spring which is not brought into contact with the printed board.

7. A connector according to claim 1, wherein said conductive paths of said repeater pin block comprise a molded insulating resin member plated with a conductive material.

8. A connector according to claim 1, wherein said repeater pin block comprises an insulating resin and a conductive resin, said conductive resin comprising said conductive paths of said repeater pin block.

9. A method for electrically connecting a printed board to an external unit, comprising the steps of:

regularly arranging through holes in a main body, a repeater pin block comprising said main body;

continuously extending a continuously extended resin spring contact portion from said main body, said continuously extended resin spring to be brought into contact with a surface of said printed board, said main body and said continuously extended resin spring contact portion comprising contact portions to be brought into contact with conductive pads of the printed board and conductive paths to be connected to said regularly arranged through holes;

forcibly inserting connector pins into said regularly arranged through holes, each of said connector pins having a first pin portion on a first end thereof, and a second pin portion on a second end thereof, said second pin portion being sued for electrical connection with the external unit; and arranging said contact portions on said continuously extended resin spring contact portion so that said contact portions can be brought into contact with said conductive pads.

10. A method for electrically connecting a printed circuit board to an external unit as claimed in claim 9, wherein said step of continuously extending further comprises continuously extending a comb-like contact having beam-like springs respectively corresponding to said conductive paths.

11. A method for electrically connecting a printed board to an external unit according to claim 10, further comprising the step of:

coupling free ends of said beam-like springs to each other using a mold carrier.

12. A method for electrically connecting a printed circuit to an external unit according to claim 10, further comprising the step of:

forming on a surface of said comb-like contact, ground conductive patterns corresponding to at least said conductive paths, said surface of said comb-like contact not being brought into contact with the printed circuit board.

13. A method for electrically connecting a printed board to an external unit according to claim 11, further comprising the step of:

providing notched portions arranged between said beam-like springs and said mold carrier, in order to remove said mold carrier.

14. A method for electrically connecting a printed board to an external unit according to claim 9, wherein said step of continuously extending a continuously extended resin spring contact portion further comprises continuously extending a one plate-like spring.

15. A method for electrically connecting a printed board to an external unit according to claim 14, further comprising the step of:

forming a ground conductive layer on the entire surface of said plate-like spring, said ground conductive layer not being in contact with the printed circuit board.

16. A method for electrically connecting a printed board to an external unit according to claim 9, further comprising the step of forming said conductive pads of said repeater pin block by plating a molded insulating resin member with a conductive material.

17. A method for electrically connecting a printed board to an external unit further comprising a step of forming said repeater pin block using an insulating resin and a conductive resin, said conductive resin comprising said conductive paths in a repeater pin block.

* * * * *